US008783677B2

(12) United States Patent
Matsushima et al.

(10) Patent No.: US 8,783,677 B2
(45) Date of Patent: Jul. 22, 2014

(54) SHEET FEEDING APPARATUS AND IMAGE FORMING APPARATUS

(71) Applicant: Canon Kabushiki Kaisha, Tokyo (JP)

(72) Inventors: Akira Matsushima, Susono (JP); Takaaki Kawade, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/043,049

(22) Filed: Oct. 1, 2013

(65) Prior Publication Data

US 2014/0125005 A1 May 8, 2014

(30) Foreign Application Priority Data

Nov. 5, 2012 (JP) ..... 2012-243237

(51) Int. Cl.
*B65H 1/08* (2006.01)
*B65H 1/14* (2006.01)

(52) U.S. Cl.
CPC ..... *B65H 1/14* (2013.01)
USPC ..... 271/147

(58) Field of Classification Search
CPC ..... B65H 1/14; B65H 31/18; B65H 2405/35; B65H 2405/571; B65H 2405/527
USPC ..... 271/147, 213, 214, 217; 221/227; 312/61, 71
See application file for complete search history.

(56) References Cited

U.S. PATENT DOCUMENTS

| | | | | |
|---|---|---|---|---|
| 6,206,366 | B1 * | 3/2001 | Schmid | 271/217 |
| 6,643,480 | B2 | 11/2003 | Kuwata et al. | |
| 6,871,848 | B2 | 3/2005 | Matsushima et al. | |
| 7,971,868 | B2 | 7/2011 | Matsushima et al. | |
| 7,971,875 | B2 * | 7/2011 | Iino et al. | 271/213 |
| 8,041,285 | B2 * | 10/2011 | Hashimoto et al. | 399/379 |
| 8,302,956 | B2 | 11/2012 | Matsushima et al. | |
| 2012/0256367 | A1 | 10/2012 | Matsushima et al. | |

FOREIGN PATENT DOCUMENTS

JP 2007-197204 A 8/2007

* cited by examiner

*Primary Examiner* — David H Bollinger
(74) *Attorney, Agent, or Firm* — Fitzpatrick, Cella, Harper & Scinto

(57) ABSTRACT

A sheet stacking portion is provided in a sheet storing portion in which sheets are stored. The sheet stacking portion is suspended by a wire which is wound up and wound off. The sheet stacking portion is raised and lowered by winding up and winding off the wire. Then, when the wire is in a slack state, a fixing portion fixes the sheet stacking portion to the sheet storing portion. When the wire is in a tensioned state, the fixing of the sheet stacking portion is released.

11 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a structure configured to fix a sheet stacking portion suspended by a flexible member.

2. Description of the Related Art

Hitherto, there are known image forming apparatus, such as a printer, a copying machine, and a facsimile machine, which include a sheet feeding apparatus configured to feed a sheet to an image forming portion. Further, as the sheet feeding apparatus, there is known one in which sheets are stacked on a sheet stacking portion which is provided in a sheet storing portion in a manner that the sheet stacking portion can be raised and lowered, and after the sheet stacking portion is raised to a sheet feedable position, the sheet is sent toward the image forming portion by a sheet feeding portion. As such a sheet feeding apparatus, there is known one in which the sheet stacking portion is suspended by a wire. When the sheets are stacked, the wire is wound off to lower the sheet stacking portion to a predetermined sheet stacking position so as to facilitate the stacking of the sheets.

The sheet feeding apparatus includes a sheet surface sensor configured to detect a level of the uppermost sheet of sheets stacked on the sheet stacking portion. The sheet surface sensor is turned OFF when the uppermost sheet is located at a feedable level, that is, when the sheet can be fed. When the level of the uppermost sheet becomes lower than the feedable level after the sheets are sequentially fed, the sheet surface sensor is turned ON.

When the sheet surface sensor is turned ON, a control portion in turn drives a motor to rotate a winding-up drum, to thereby wind up the wire. With this, the sheet stacking portion is raised. When the level of the uppermost sheet reaches the feedable level, the sheet surface sensor is turned OFF to stop the motor and stop the sheet stacking portion. During feeding of the sheets, this operation is repeated to constantly maintain the level of the uppermost sheet within a range of a substantially constant level.

By the way, the sheet stacking portion is suspended in the sheet storing portion so that the sheet stacking portion can be raised and lowered. Therefore, for example, when the sheet stacking portion significantly swings due to vibration or impact during transportation of an image forming apparatus, the sheet stacking portion or the peripheral member thereof may be scratched or damaged. In view of this, conventionally, as disclosed in, for example, Japanese Patent Application Laid-Open No. 2007-197204, a tape, a fixing member for transportation purpose, or the like is used to fix the sheet stacking portion to the sheet storing portion, to thereby prevent the scratch and damage due to the vibration or impact during transportation.

However, in the case of the conventional sheet feeding apparatus and image forming apparatus in which the sheet stacking portion is fixed by the tape as described above, when the adhesion of the tape is weak, the tape may peel off during transportation, while when the adhesion is too strong, it is difficult to remove the tape. Further, in the case where the fixing member for transportation purpose is used, it is necessary to mount the fixing member at the time of assembly, and a user needs to remove the fixing member before use. Thus, a large amount of time and effort is required.

Further, when the user forgets to remove the tape or the fixing member before use, the sheet stacking portion is raised in a state in which the tape or the fixing member is fixed, and hence the sheet stacking portion or the peripheral member thereof may be scratched or damaged when the sheet stacking portion is raised. Further, after the fixing member is removed, if the user lifts the sheet stacking portion while the sheet stacking portion is raised to the sheet feedable position or while the sheet stacking portion is lowered from the sheet feedable position, the wire may be slacked to be disengaged, or the slack wire may be caught on a frame or the like to cause damage or the like.

SUMMARY OF THE INVENTION

The present invention has been made in view of such circumstances, and provides a sheet feeding apparatus and an image forming apparatus in which a sheet stacking portion can be fixed without using a tape or a fixing member.

According to one embodiment of the present invention, there is provided a sheet feeding apparatus, comprising: a sheet storing portion in which sheets are stored; a sheet feeding portion configured to feed the sheets; a sheet stacking portion disposed in the sheet storing portion and suspended by a flexible member; a raising and lowering portion configured to raise the sheet stacking portion by winding up the flexible member; and a fixing portion configured to engage with the sheet storing portion to fix the sheet stacking portion to the sheet storing portion when the flexible member is in a slack state, and release an engagement of the fixing portion with the sheet storing portion to release a fixing of the sheet stacking portion when the flexible member is in a tensioned state.

The preferred embodiments of the present invention will be described in detail in accordance with the accompanying drawings.

DESCRIPTION OF THE EMBODIMENTS

Figure 1:
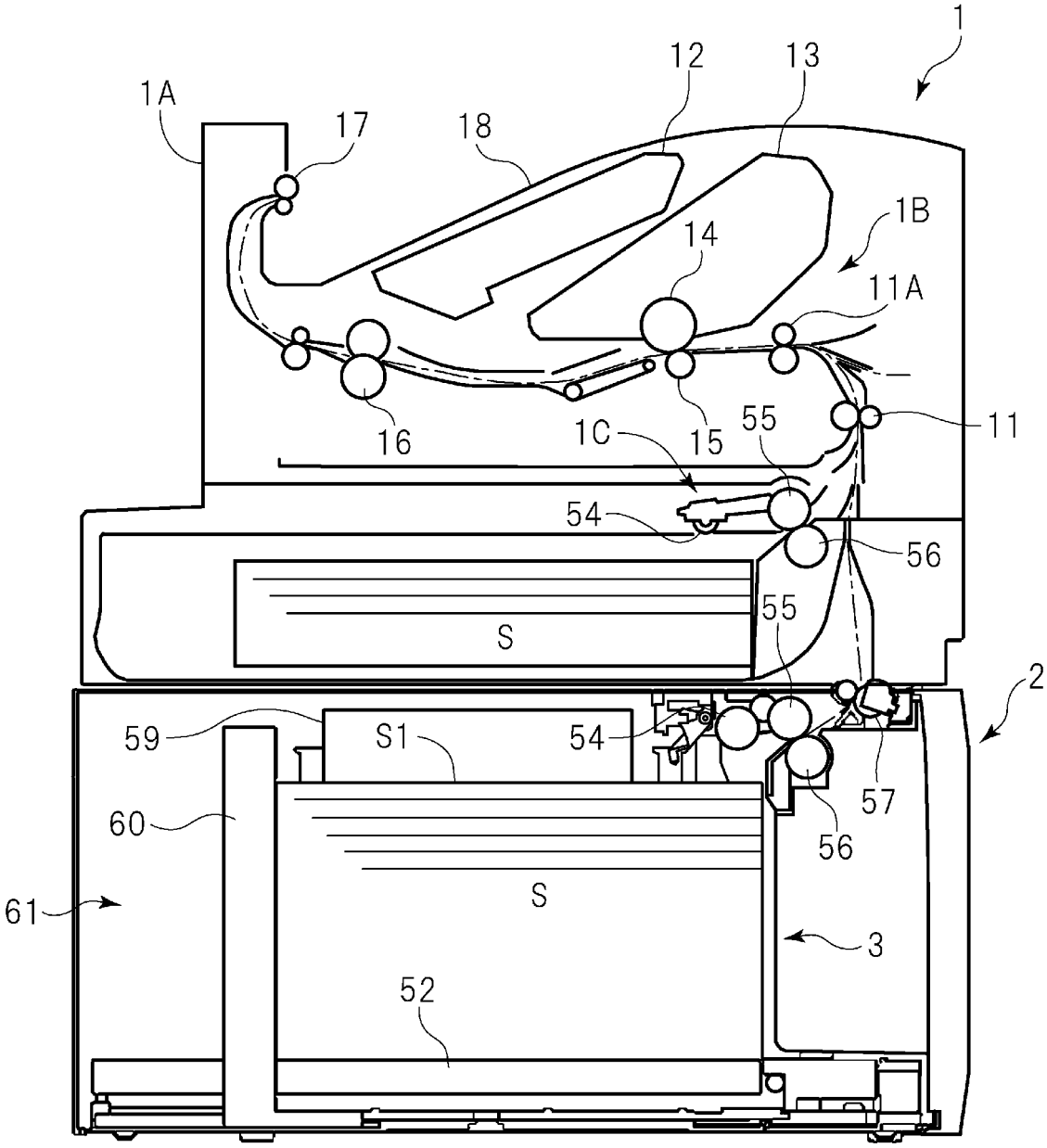
FIG. 1 is a view illustrating a schematic structure of an image forming apparatus including a large-capacity sheet feeding apparatus as an example of a sheet feeding apparatus according to a first embodiment of the present invention.

The embodiments of the present invention will hereinafter be described in detail with reference to the accompanying drawings. FIG. 1 is a view illustrating a schematic structure of an image forming apparatus including a large-capacity sheet feeding apparatus as an example of a sheet feeding apparatus according to a first embodiment of the present invention. In FIG. 1, an image forming apparatus 1 includes an image forming apparatus main body (hereinafter referred to as "apparatus main body") 1A and a large-capacity sheet feeding apparatus (hereinafter referred to as "feeding unit") 2 mounted to the apparatus main body 1A. The apparatus main body 1A includes an image forming portion 1B configured to perform image formation by an electrophotographic method. The image forming portion 1B includes a photosensitive drum 14 configured to form a toner image, a laser scanner 12 configured to irradiate the photosensitive drum 14 with light in accordance with an image signal, and a transfer roller 15 configured to transfer the toner image formed on the photosensitive drum 14 onto a sheet S.

When an image forming operation is started in the image forming portion 1B having such a structure, first, the laser scanner 12 irradiates the photosensitive drum 14 with light in accordance with the image signal. When light is radiated in accordance with the image signal as described above, a latent image is formed on the photosensitive drum. Next, this latent image is developed by toner stored in a toner cartridge 13, to thereby form a toner image (visible image) on the photosensitive drum.

Further, in parallel to this toner image forming operation, the sheet S is fed from a main body feeding portion 1C provided on the lower side of the apparatus main body 1A, or from the feeding unit 2. Then, the sheet S is conveyed by conveyance rollers 11 and registration rollers 11A to a transfer portion formed of the photosensitive drum 14 and the transfer roller 15 in synchronization with the image formed on the photosensitive drum 14. Then, a transfer voltage is applied to the transfer roller 15 at the transfer portion to transfer the toner image onto the sheet S. Note that, the sheet S having the toner image transferred thereon is thereafter conveyed to a fixing unit 16. The sheet S is heated in the fixing unit 16 so that the toner image is fixed to the sheet S. Thereafter, the sheet S is delivered onto a delivery portion 18 on the upper side of the apparatus main body by delivery rollers 17.

By the way, the feeding unit 2 includes a sheet storing device 3 which is provided so as to be freely raised and lowered inside a sheet storage 61 serving as a sheet storing portion configured to store sheets. The sheet storing device 3 includes a plate-shaped sheet stacking portion 52 on which a large number of sheets S are stacked and regulation plates 58, 59, and 60 to be described later. Further, the feeding unit 2 includes a feeding roller 54 serving as a sheet feeding portion configured to send an uppermost sheet S1 of the sheets S stacked on the sheet stacking portion 52.

Further, the feeding unit 2 includes a separation roller pair 55 and 56 formed of a feed roller 55 and a retard roller 56 configured to separate the sheet S sent by the feeding roller 54. Further, the feeding unit 2 includes a conveyance roller 57 configured to convey the sheet S separated and fed one by one by the separation roller pair 55 and 56 to the apparatus main body 1A. Note that, the main body feeding portion 1C provided on the lower side of the apparatus main body 1A also includes the feeding roller 54 and the separation roller pair 55 and 56.

Figure 2A:
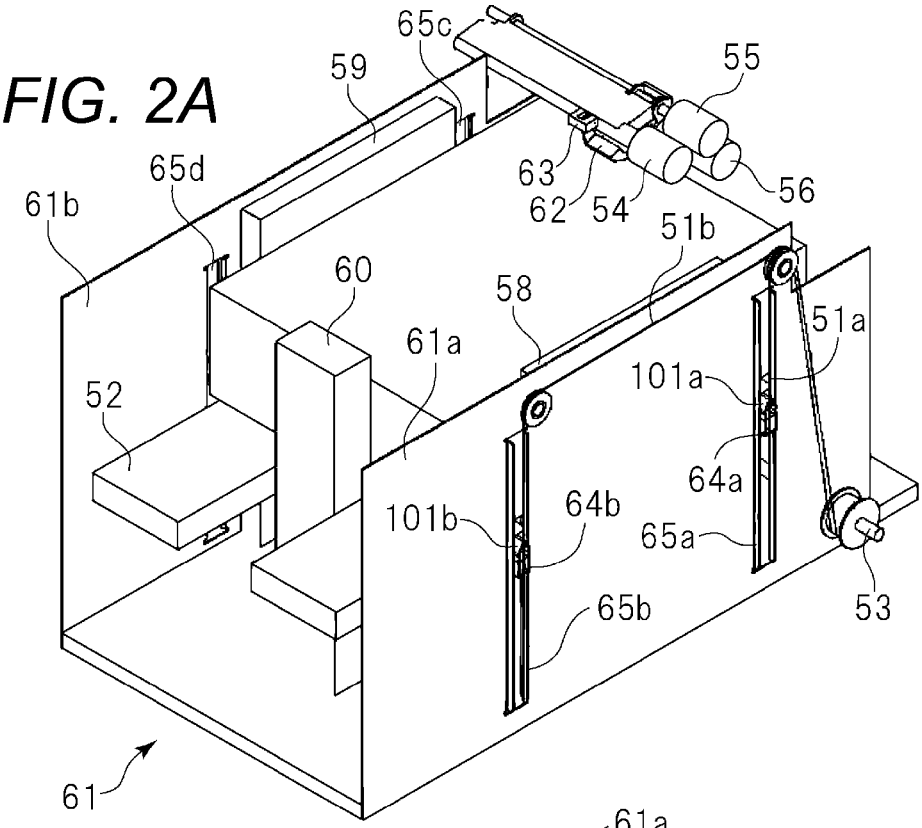
FIGS. 2A and 2B are views illustrating a structure of sheet storage of the large-capacity sheet feeding apparatus.
Figure 2B:
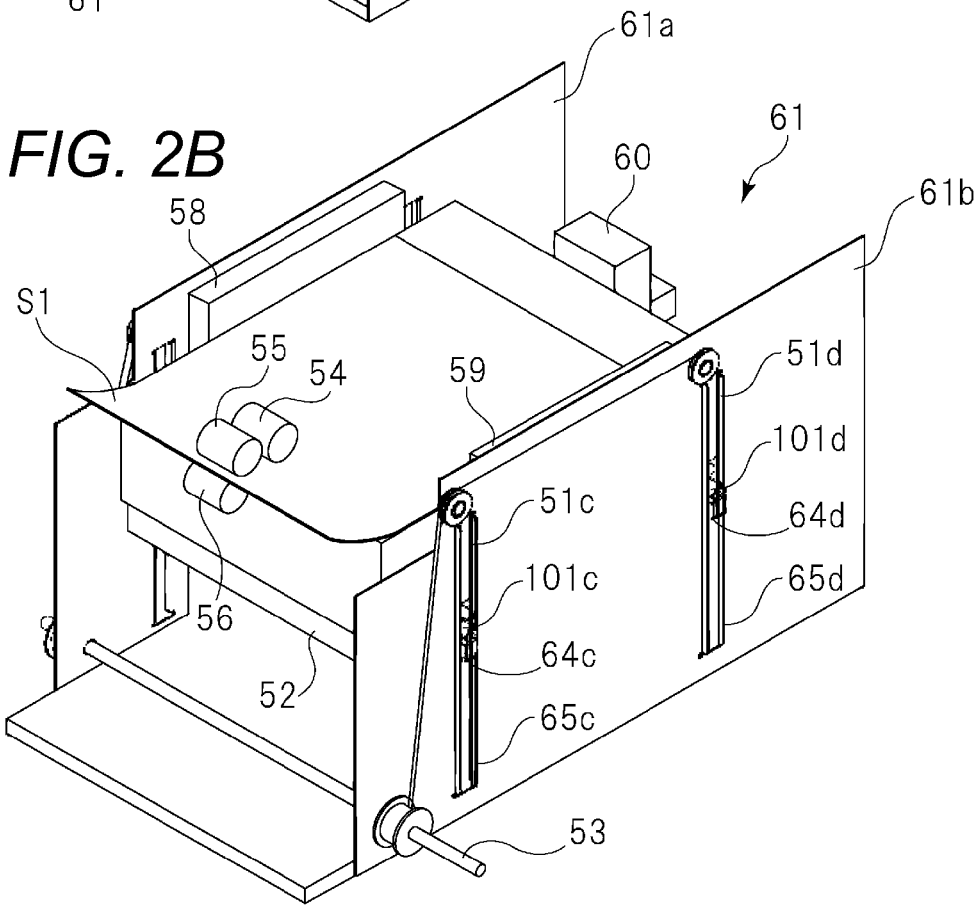

In this case, as illustrated in FIGS. 2A and 2B, the sheet storage 61 includes side plates 61*a* and 61*b* serving as a main body frame located on the lateral sides of the sheet stacking portion 52. The sheet stacking portion 52 includes wire suspended portions 64 (64*a*, 64*b*, 64*c*, and 64*d*) outwardly protruded from opening portions 65 (65*a*, 65*b*, 65*c*, and 65*d*) formed in the up-and-down direction in the side plates 61*a* and 61*b* of the sheet storage 61. Further, wires 51 (51*a*, 51*b*, 51*c*, and 51*d*) serving as flexible members are respectively fixed to the wire suspended portions 64. The wires 51 are wound up or wound off by a wire winding-up shaft 53, to thereby move (raise or lower) the sheet stacking portion 52 in the up-and-down direction. Note that, in FIG. 2A, a sheet surface detection sensor 63 detects the level of the uppermost sheet of the sheets stacked on the sheet stacking portion 52.

Figure 3:
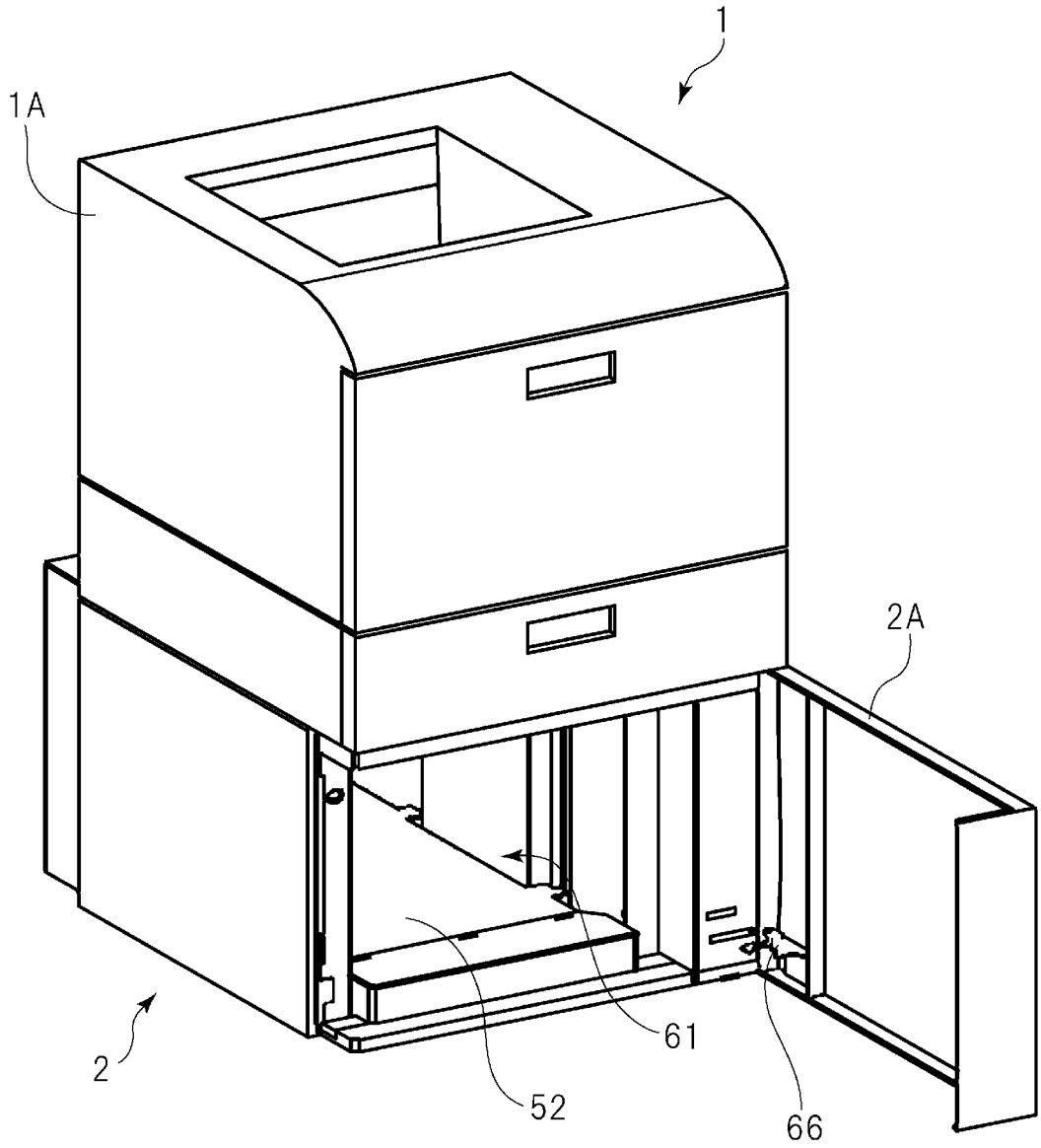
FIG. 3 is a view illustrating a state in which a door of the sheet feeding apparatus is opened.

Further, as illustrated in FIG. 3, the feeding unit 2 includes a door 2A which is opened when the sheets S are to be stacked on the sheet stacking portion 52. In this embodiment, when the door 2A is opened as illustrated in FIG. 3, the wire winding-up shaft 53 illustrated in FIGS. 2A and 2B rotates in a winding-off direction in which the wires 51 are wound off. With this, the sheet stacking portion 52 is lowered from a sheet feedable position to a lowermost stacking position in which the sheets S are loaded onto the sheet stacking portion 52 as illustrated in FIG. 3. In other words, when the door 2A is opened, the sheet stacking portion 52 is lowered to the lowermost stacking position for stacking the sheets S.

Figure 4:
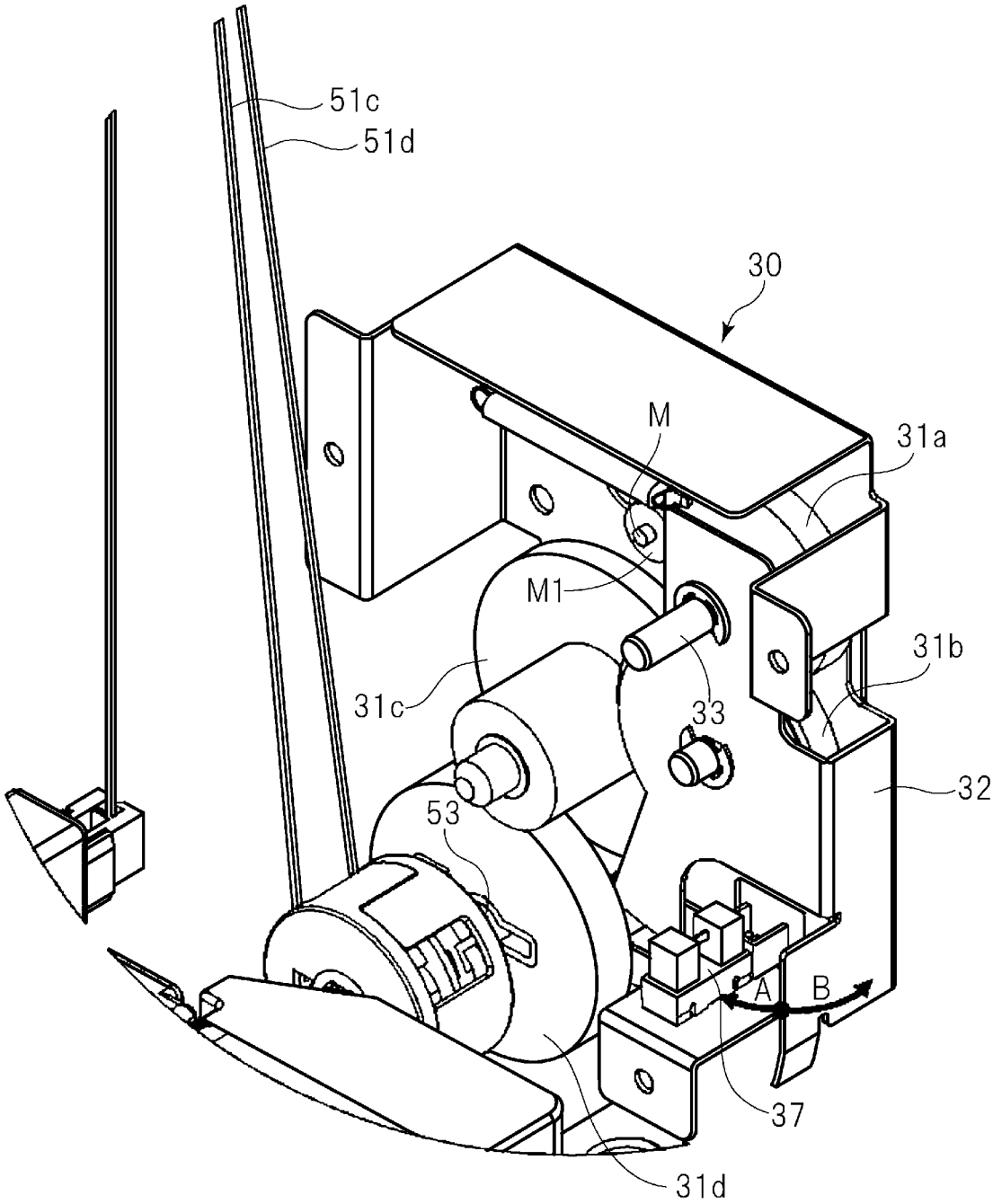
FIG. 4 is a view illustrating a structure of a drive unit provided in the sheet feeding apparatus.

By the way, FIG. 4 is a view illustrating a structure of a drive unit 30 serving as a raising and lowering portion configured to raise and lower the sheet stacking portion 52 by winding up and winding off the wires 51, and configured to hold the raised or lowered sheet stacking portion 52. The drive unit 30 includes a motor M, a motor gear M1 which is rotated by the motor M, and four stepped gears 31 (31*a*, 31*b*, 31*c*, and 31*d*) configured to transmit the rotation motion of the motor gear M1 to the wire winding-up shaft 53. Further, the drive unit 30 includes a drive releasing member 32 which holds the stepped gear 31*b*, and serves as a releasing portion configured to release the hold of the sheet stacking portion 52 by the drive unit 30. The drive releasing member 32 is swingable about a shaft 33. Further, the drive unit 30 includes a sensor 37 configured to detect that the door 2A is closed.

Note that, a one-way clutch (not shown) is built into the stepped gear 31*a*. With this one-way clutch, the stepped gear 31*a* freely rotates in a direction in which the sheet stacking portion 52 is raised, and the rotation motion is locked in a direction in which the sheet stacking portion 52 is lowered. With this, the sheet stacking portion 52 is held at the position after being raised.

In the drive unit 30 having this structure, when the door 2A is opened, first, a hooking portion 66 provided on the door 2A causes the drive releasing member 32 to swing about the shaft 33 in a direction indicated by the arrow B of FIG. 4. Along therewith, the meshing between the stepped gear 31*b* provided in the drive releasing member 32 and the stepped gear 31*c* which is fixed on the wire winding-up shaft 53 and transmits the rotation motion of the motor M to the wire winding-up shaft 53 is released.

With this, the transmission of the drive of the motor M to the wire winding-up shaft 53 is released, and along therewith, the hold of the sheet stacking portion 52 by the drive unit 30 is released. Thus, the wire winding-up shaft 53 becomes rotatable. As a result, with the aid of the weight of the sheets S stacked on the sheet stacking portion 52 and the weight of the sheet stacking portion itself, which are exerted on the wire winding-up shaft 53 via the wires 51, the wire winding-up shaft 53 is rotated in a direction in which the wires 51 are wound off. Along therewith, the sheet stacking portion 52 is lowered to the lowermost stacking position.

Further, when the stacking of the sheets onto the sheet stacking portion 52 is completed and the door 2A is closed, a pressing portion (not shown) provided on the door 2A presses the drive releasing member 32 to cause the drive releasing member 32 to swing in a direction indicated by the arrow A of FIG. 4. With this, the stepped gear 31*b* provided on the drive releasing member 32 and the stepped gear 31*c* mesh with each other, to thereby enable transmission of the drive of the motor M to the wire winding-up shaft 53. Then, when the sensor 37 detects the swinging of the drive releasing member 32, a control portion (not shown) determines that the door 2A is closed based on the detection signal from the sensor 37, and the motor M is rotated. With this, the wire winding-up shaft rotates in a wire winding-up direction, and along therewith, the wires 51 are wound up to raise the sheet stacking portion 52.

After that, the uppermost sheet of the sheets stacked on the sheet stacking portion 52 is brought into abutment against a sheet surface detection flag 62. Thus, the sheet surface detection flag 62 is rotated to switch ON and OFF of the signal of the sheet surface detection sensor 63. Then, based on the signal from the sheet surface detection sensor 63, the control portion (not shown) causes the sheet stacking portion 52 to move to a feedable position (range) which enables the uppermost sheet S1 to be fed and smoothly enter a nip between the separation roller pair 55 and 56 as illustrated in FIGS. 2A and 2B referred to above. After that, the control portion controls the raising of the sheet stacking portion 52 so that the uppermost sheet S1 of the stacked sheets is maintained at the feedable position.

Figure 5A:
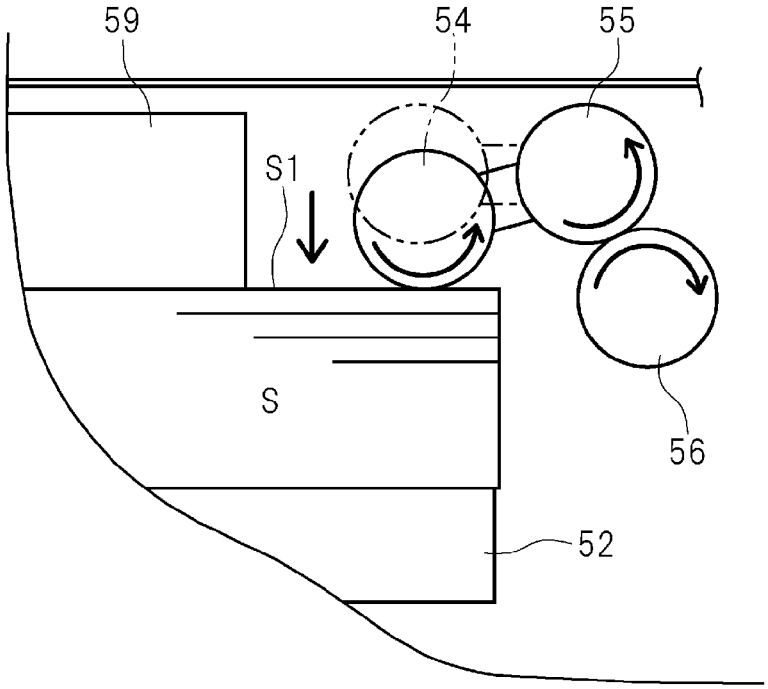
FIGS. 5A and 5B are views illustrating a sheet feeding operation of the sheet feeding apparatus.

Note that, after the sheet stacking portion 52 is raised and the level of the uppermost sheet reaches the feedable level as described above, in response to a feeding signal sent from the image forming apparatus 1, the control portion drives the feeding roller 54. Then, as illustrated in FIG. 5A, the feeding roller 54 rotates while abutting against the uppermost sheet S1, and thus the uppermost sheet S1 is fed to the separation roller pair 55 and 56. Then, the separation roller pair 55 and 56 separates and feeds the sheet sent by the feeding roller 54 one by one, and the separated and fed sheet is sent to the image forming apparatus.

Figure 5B:
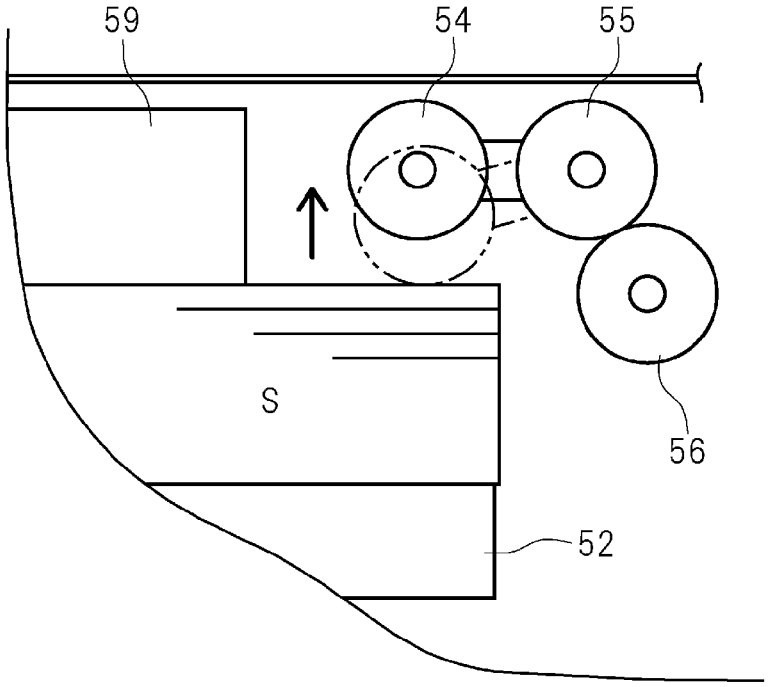

Further, after the feeding roller 54 sends the sheet to the separation roller pair 55 and 56, as illustrated in FIG. 5B, the feeding roller 54 retracts above the sheets so as not to contact the sheet in order not to inhibit the separation of the sheets by the separation roller pair 55 and 56. Every time the feeding signal is sent from the image forming apparatus 1, the above-mentioned operation is repeated to send the sheets to the apparatus main body 1A one by one.

Figure 6:
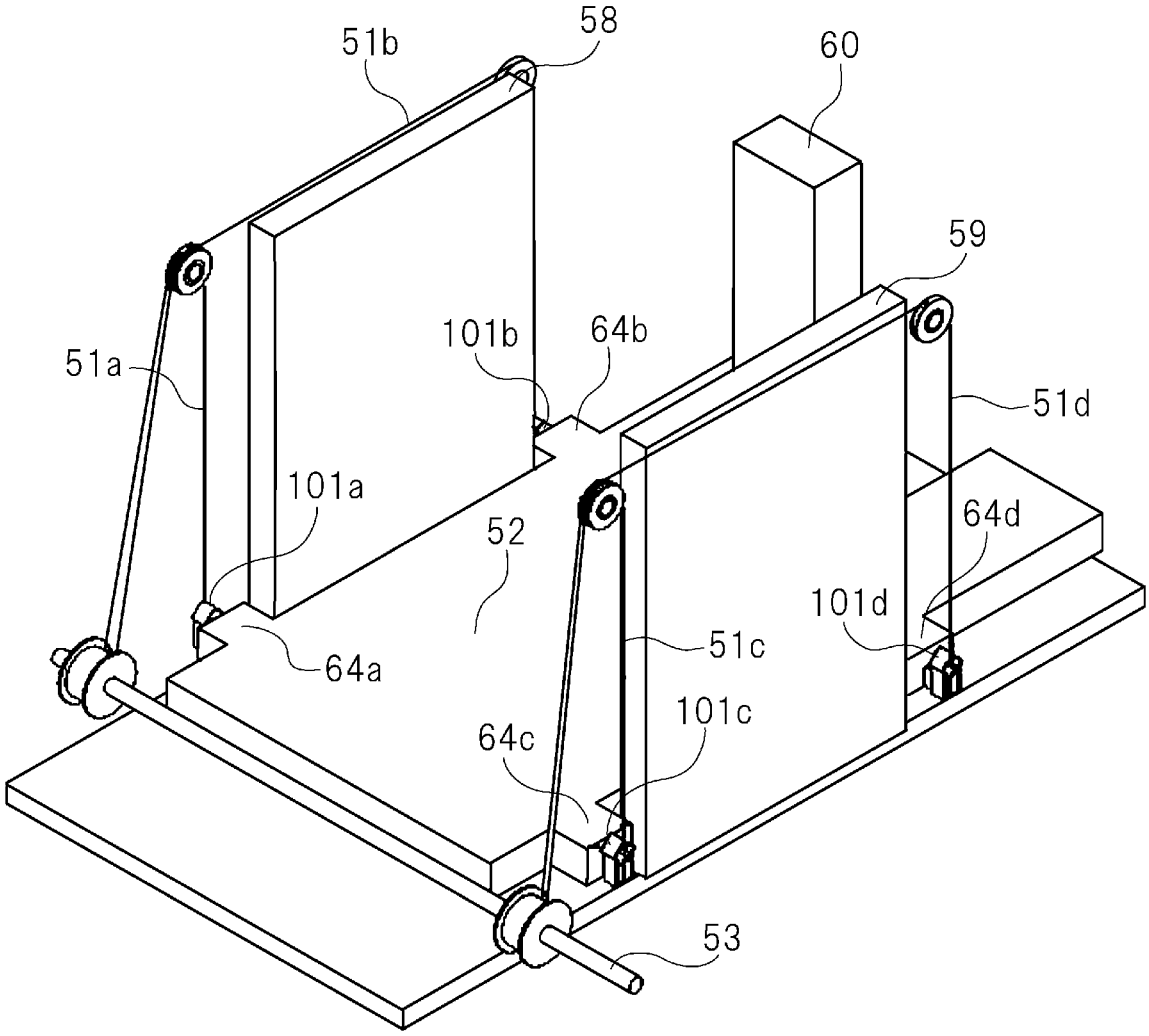
FIG. 6 is a view illustrating a structure configured to fix a sheet stacking portion of the sheet feeding apparatus.
Figure 7A:
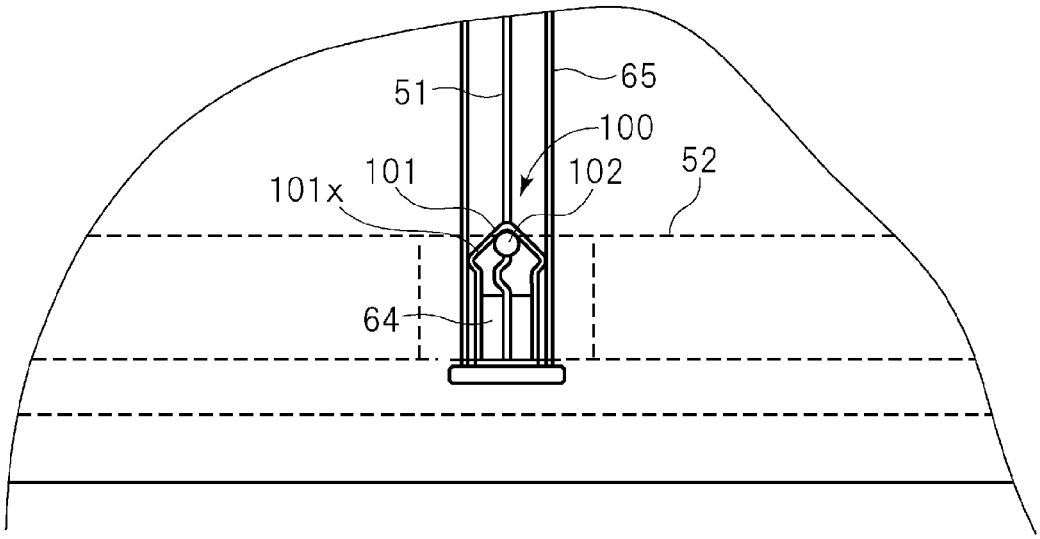
FIGS. 7A and 7B are views illustrating an operation of a fixing portion provided in the sheet feeding apparatus.
Figure 7B:
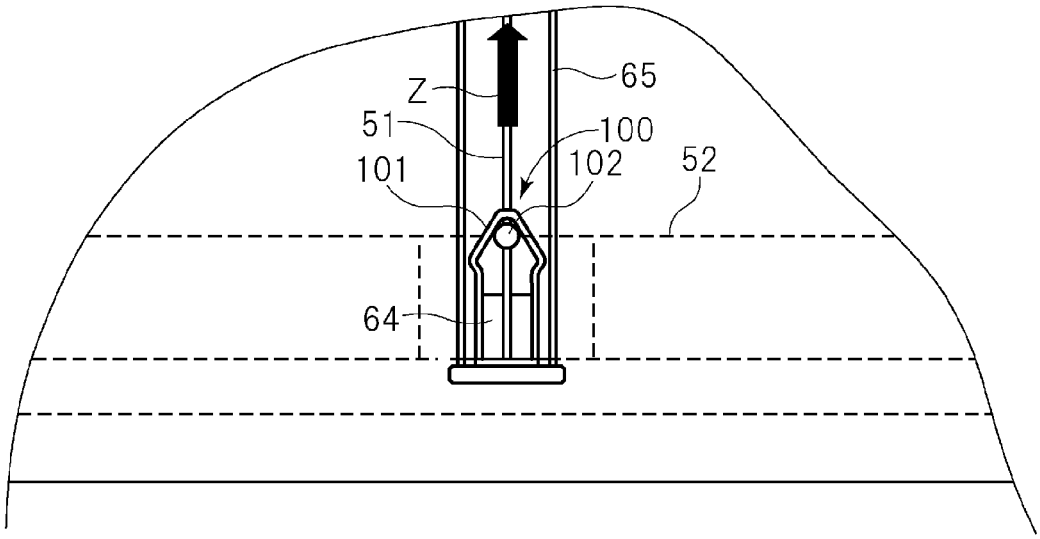

Next, a fixing portion 100 will be described. In this embodiment, as illustrated in FIG. 6, in the vicinity of the wire suspended portions 64 (64*a*, 64*b*, 64*c*, and 64*d*) of the sheet stacking portion 52, four fixing members 101 (101*a*, 101*b*, 101*c*, and 101*d*) each formed of a flat spring are provided. As illustrated in FIGS. 7A and 7B, the fixing members 101 (101*a*, 101*b*, 101*c*, and 101*d*) serving as elastic members are provided so as to be located inside the opening portions 65 (65*a*, 65*b*, 65*c*, and 65*d*), respectively. FIG. 7A is a view illustrating a state in which the wire 51 is slacked. FIG. 7B is a view illustrating a state in which the wire 51 is tensioned. Edge portions of the opening portion 65, which form a portion to be engaged disposed at the opening portion 65, are formed into a flange shape, and the fixing member 101 can be held in pressure contact with the edge portions. When the wire 51 is in a slack state, a laterally wide portion 101*x* on the upper side of the fixing member 101 elastically engages with wall surfaces on both sides of the opening portion 65 in a pressure contact manner as illustrated in FIG. 7A. In this state, the elastically deformable fixing member 101 is not in an elastically deformed state.

Further, the wire 51 extends through the upper end of the fixing member 101. One end portion of the wire 51 is located on the inner side of the fixing member 101. A crimp bead 102 serving as a releasing member is fixed on the one end portion. When the wire 51 is in a tensioned state due to winding up and winding off of the wire 51, the crimp bead 102 is raised due to the tension of the wire 51 as indicated by an arrow Z of FIG. 7B, and is brought into pressure contact with the upper end portion of the fixing member 101 upwardly from the lower side. When the crimp bead 102 is brought into pressure contact as described above, the fixing member 101 is elastically deformed, and the wide portion 101*x* is separated from the wall surfaces on both the sides of the opening portion 65 extending in the up-and-down direction. In this manner, the engagement of the fixing member 101 with the opening portion 65 is released.

In other words, the fixing member 101 is provided so as to be deformable in association with the movement of the wire 51. When the crimp bead 102 exerts an upward force on the fixing member 101 to deform the fixing member 101, the fixing member 101 is separated from the wall surfaces on both the sides of the opening portion 65 to release the engagement of the fixing member 101 with the opening portion 65. The same structure is employed in all of the fixing members 101*a*, 101*b*, 101*c*, and 101*d*. As described above, the fixing portion 100 configured to fix the sheet stacking portion 52 to the sheet storage 61 when the wire 51 is in a slack state, and release the fixing of the sheet stacking portion 52 to the sheet storage 61 when the wire 51 is in a tensioned state, is formed of the edge portions of the opening portion 65, the crimp bead 102, and the fixing member 101.

Note that, during transportation, the sheet stacking portion 52 is placed in the sheet storage at the lowermost stacking position. At this time, as illustrated in FIG. 7A, the wire 51 is in a slack state and the fixing member 101 is in a contracted state due to the spring force. In such a contracted state, end portions on both sides of the fixing member 101 are held in contact with the wall surfaces on both the sides of the opening portion 65 of the sheet storage due to the spring force to fix the sheet stacking portion 52.

Further, during normal operation, when the winding-up operation of the wire 51 starts, as illustrated in FIG. 7B, the crimp bead 102 provided on the wire 51 is brought into pressure contact with the fixing member 101 from the lower side to cause elastic deformation of the fixing member 101 against the spring force of the fixing member 101. With this, the fixing member 101 is separated from the opening portion 65 of the sheet storage 61 to release the fixing by the fixing member 101. In this manner, the sheet stacking portion 52 can be raised.

As described above, in this embodiment, when the wire 51 is in a slack state, the fixing portion 100 fixes the sheet stacking portion 52 to the sheet storage 61, and when the wire 51 is in a tensioned state, the fixing of the sheet stacking portion 52 is released. With this, without using a tape or a fixing member for transportation purpose, the sheet stacking portion 52 can be fixed. Further, the fixing of the sheet stacking portion 52 can be released without removing the fixing member 101. As a result, without any time and effort for attaching and removing the tape or the fixing member for transportation purpose, the sheet stacking portion 52 can be prevented from being scratched or damaged due to vibration or impact during transportation of the sheet stacking portion 52.

Further, even if a user turns on the power in this state and the sheet stacking portion 52 is raised, the sheet stacking portion 52 or the periphery member thereof is not scratched or damaged. Further, even when the sheet stacking portion 52 is located at a position in the middle of the raising or lowering, the sheet stacking portion 52 can be fixed. Therefore, when the user lifts the sheet stacking portion 52, it is possible to prevent the wire 51 from being slacked to be disengaged or prevent the slack wire 51 from being caught to a frame or the like to be damaged.

Figure 8:
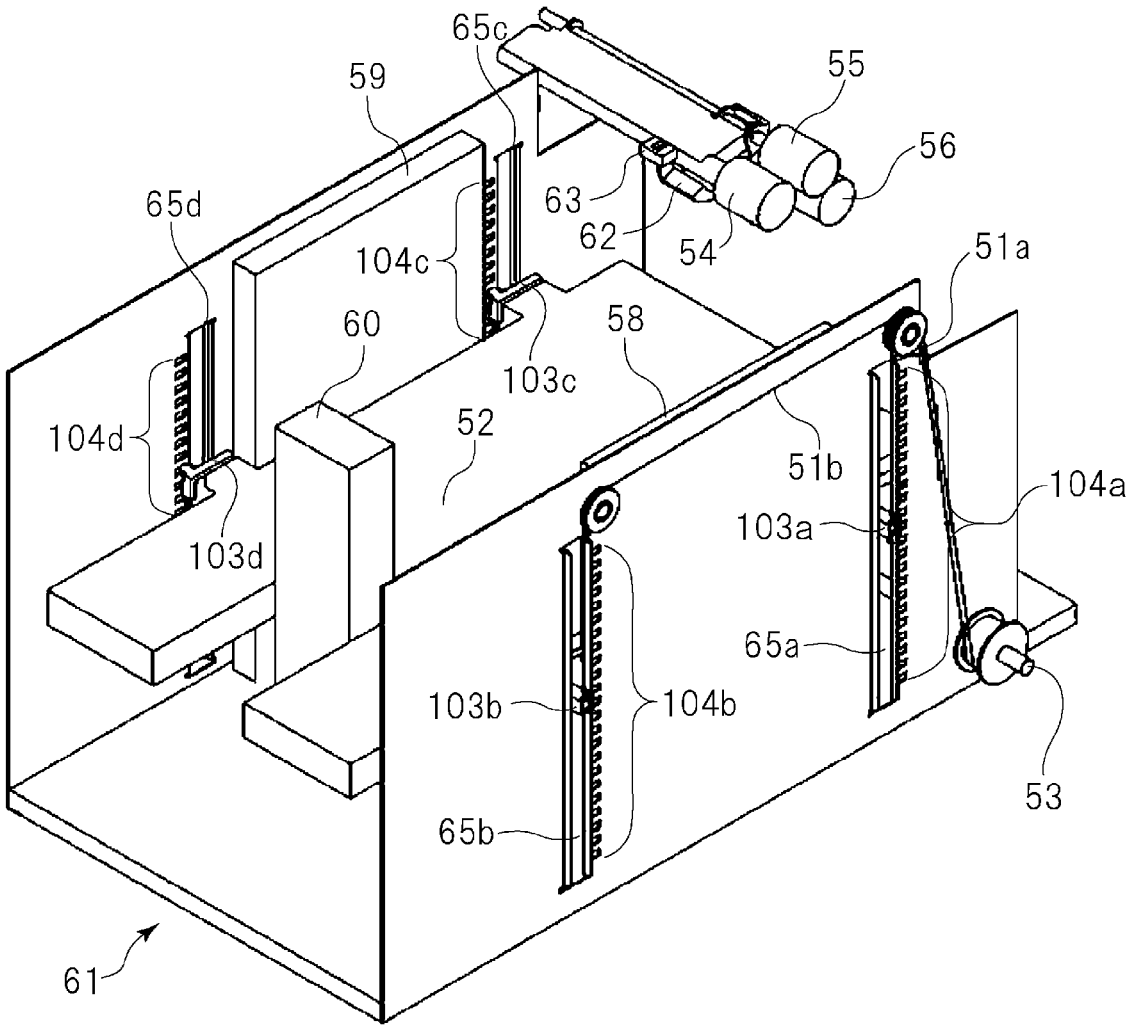
FIG. 8 is a view illustrating a structure of a sheet storage of a sheet feeding apparatus according to a second embodiment of the present invention.

Next, a second embodiment of the present invention will be described. FIG. 8 is a view illustrating a structure of a sheet storage of a sheet feeding apparatus according to the embodiment. Note that, in FIG. 8, the same reference symbols as those of FIGS. 2A and 2B referred to above represent the same or corresponding parts.

In FIG. 8, a plurality of fitting holes 104 (104*a*, 104*b*, 104*c*, and 104*d*) serving as portions to be engaged are formed in the up-and-down direction in the vicinity of the respective wire suspended portions of the sheet storage 61. Further, wire suspended members 103 (103*a*, 103*b*, 103*c*, and 103*d*) serving as fixing members are provided on the sheet stacking portion 52.

Figure 9A:
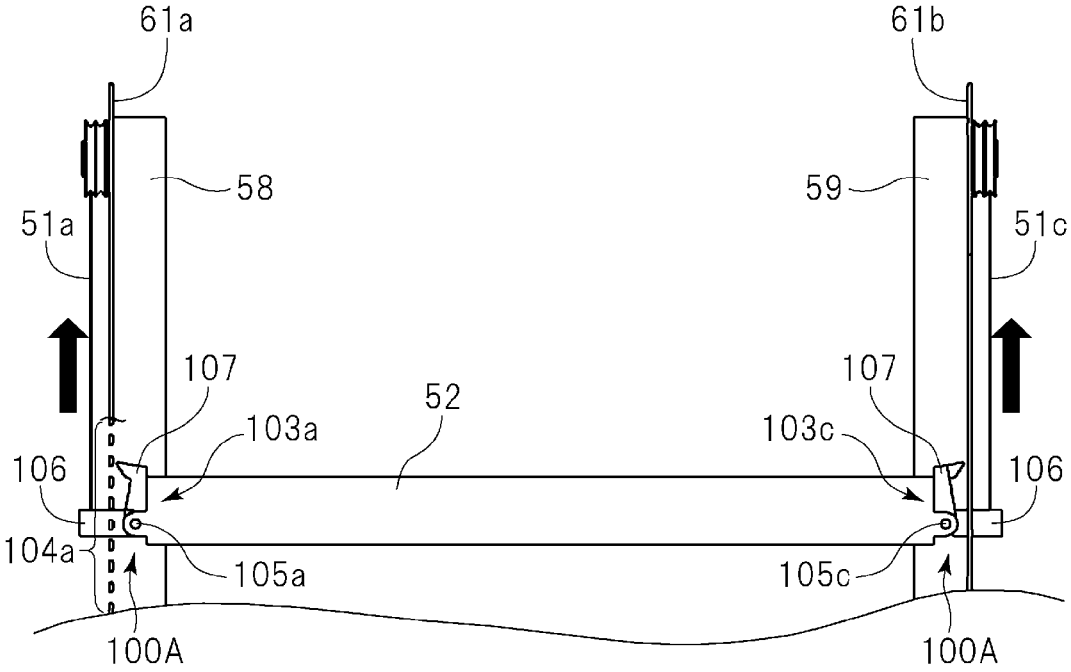
FIGS. 9A and 9B are schematic detail views of a fixing member according to the second embodiment of the present invention.
Figure 9B:
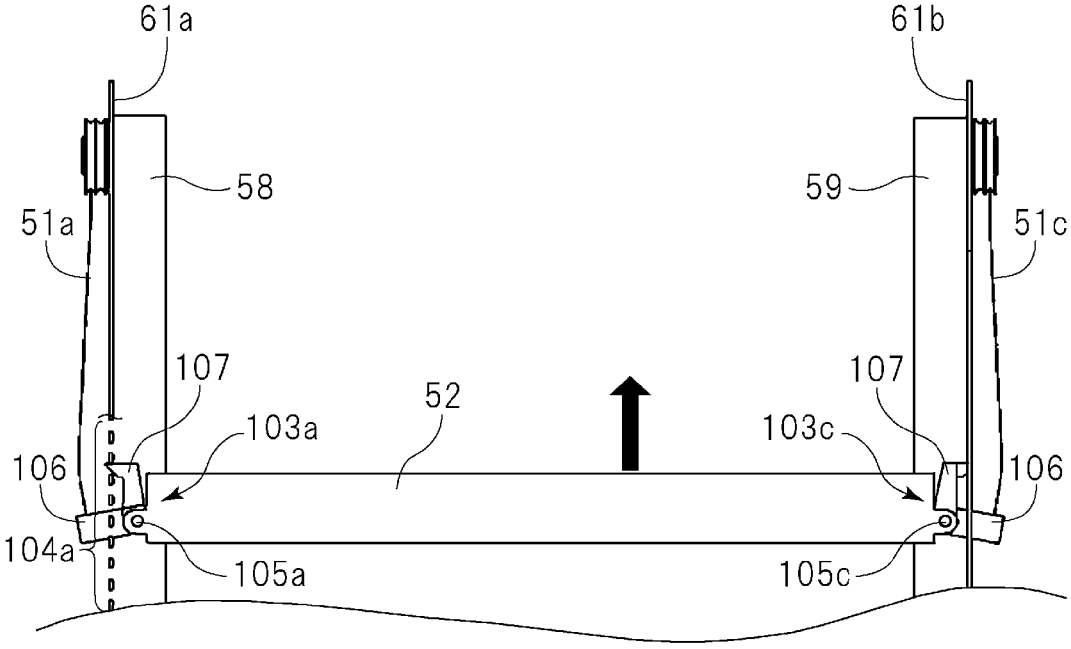

As illustrated in FIGS. 9A and 9B, the wire suspended members 103 are attached to the sheet stacking portion 52 so as to be pivotable in the up-and-down direction about shafts 105*a* and 105*c* provided at end portions of the sheet stacking portion 52, respectively. The wire suspended members 103*a* and 103*c* each include an attaching portion 106 having one end portion to which corresponding one of the wires 51*a* and 51*c* is attached, and an engaging piece 107 which extends in a direction substantially orthogonal to the attaching portion 106 and has a cusp portion which can be fitted into the fitting hole 104 in a disengageable manner. Note that, the same structure is employed in the other wire suspended members 103*b* and 103*d*. Note that, a fixing portion 100A configured to fix the sheet stacking portion 52 to the sheet storage 61 when the wire 51 is in a slack state, and release the fixing of the sheet stacking portion 52 to the sheet storage 61 when the wire 51 is in a tensioned state, is formed of the fitting holes 104 and the wire suspended member 103 including the engaging piece 107.

When the winding-up operation of the wires 51*a* and 51*c* is started to pull the wire suspended members 103*a* and 103*c* by the wires 51*a* and 51*c*, respectively, in the direction indicated by the arrows of FIG. 9A, the wire suspended members 103*a* and 103*c* pivot upwardly. Along therewith, the cusp portions of the engaging pieces 107 are disengaged from the fitting hole 104*a* and the fitting hole 104*c* illustrated in FIG. 8 referred to above. With this, the sheet stacking portion 52 can be raised.

Further, when the sheet stacking portion 52 is placed in the sheet storage at the lowermost stacking position at the time of transportation or when the user tries to lift the sheet stacking portion 52, the wires 51*a* and 51*c* are slacked as illustrated in FIG. 9B. When the wires 51*a* and 51*c* are slacked as described above, the wire suspended members 103*a* and 103*c* pivot downwardly about the shaft 105*a* and 105*c*, respectively, by their own weights, and thus the engaging pieces 107 are fitted into the fitting holes 104*a* and 104*c*, respectively. With this, the sheet stacking portion 52 is fixed.

As described above, in this embodiment, when the wire 51 is in a slack state, the fixing portion 100A fixes the sheet stacking portion 52 to the sheet storage 61, and when the wire 51 is in a tensioned state, the fixing of the sheet stacking portion 52 is released. With this, without any time and effort for attaching and removing the tape or the fixing member for transportation purpose, the sheet stacking portion 52 can be prevented from being scratched or damaged due to vibration or impact during transportation of the sheet stacking portion 52.

Note that, in the description above, a wire is used as a flexible member, but a flexible plate-shaped member may be used as the flexible member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-243237, filed Nov. 5, 2012 which is hereby incorporated by reference herein in its entirety.

What is claimed is:

1. A sheet feeding apparatus, comprising:

a sheet storing portion in which sheets are stored;

a sheet feeding portion configured to feed the sheets;

a sheet stacking portion disposed in the sheet storing portion and suspended by a flexible member;

a raising and lowering portion configured to raise the sheet stacking portion by winding up the flexible member; and a fixing portion configured to engage with the sheet storing portion to fix the sheet stacking portion to the sheet storing portion when the flexible member is in a slack state, and release an engagement of the fixing portion with the sheet storing portion to release a fixing of the sheet stacking portion when the flexible member is in a tensioned state.

2. A sheet feeding apparatus according to claim 1, wherein the fixing portion comprises:

a portion to be engaged which is provided in the sheet storing portion and extends in an up-and-down direction;

an elastic member which is provided on the sheet stacking portion and elastically engages with the portion to be engaged when the flexible member is in the slack state; and a releasing member provided on the flexible member and configured to elastically deform the elastic member to release the engagement of the elastic member with the portion to be engaged when the flexible member is in the tensioned state.

3. A sheet feeding apparatus according to claim 2, wherein an opening portion is formed in a main body frame on a lateral side of the sheet stacking portion, wherein a suspended portion is provided on the sheet stacking portion so as to be protruded outwardly from the opening portion, wherein the flexible member is attached to the suspended portion, wherein the portion to be engaged is disposed at the opening portion, and wherein the elastic member is attached to the suspended portion so as to be engageable with the portion to be engaged.

4. A sheet feeding apparatus according to claim 2, wherein the portion to be engaged is located on each of both sides of the flexible member disposed in the up-and-down direction, wherein the elastic member is elastically deformable by being pressed upwardly by the releasing member provided on the flexible member, wherein the elastic member engages with the portion to be engaged without the elastic member being elastically deformed when the flexible member is in the slack state, and wherein the elastic member is separated from the portion to be engaged with the elastic member being elastically deformed when the flexible member is in the tensioned state.

5. A sheet feeding apparatus according to claim 1, wherein the fixing portion comprises:

a plurality of portions to be engaged which are formed in the sheet storing portion in an up-and-down direction; and an engaging portion which is pivotably provided on the sheet stacking portion, the engaging portion being configured to pivot in a direction to engage with a corresponding one of the plurality of portions to be engaged when the flexible member is in the slack state, and pivot in a direction to release an engagement the engaging portion with the corresponding one of the plurality of portions to be engaged by being pulled by the flexible member when the flexible member is in the tensioned state.

6. A sheet feeding apparatus according to claim 5, wherein the plurality of portions to be engaged comprise a plurality of fitting holes which are disposed in the up-and-down direction, and wherein the engaging portion comprises an engaging piece configured to fit into the corresponding one of the plurality of fitting holes when the flexible member is in the slack state.

7. An image forming apparatus, comprising:

an image forming portion configured to form an image on a sheet; and feeding apparatus according to claim 1, the sheet feeding apparatus being configured to feed the sheet to the image forming portion.

8. A sheet feeding apparatus, comprising:

a sheet storing portion in which sheets are stored;

a sheet feeding portion configured to feed the sheets;

a sheet stacking portion disposed in the sheet storing portion and connected to a flexible member, the sheet stacking portion being suspended by the flexible member, wherein the flexible member is in a slack state when the sheet stacking portion is located at a lowermost position of the sheet storing portion;

a raising and lowering portion configured to raise the sheet stacking portion by winding up the flexible member, wherein the raising and lowering portion winds up the flexible member to raise the sheet stacking portion to put the sheet stacking portion into a state in which the sheets stacked on the sheet stacking portion are feedable by the sheet feeding portion; and a fixing portion configured to fix the sheet stacking portion to the sheet storing portion when the sheet stacking portion is located at the lowermost position and the flexible member is slacked, and release an engagement of the fixing portion with the sheet storing portion when the raising and lowering portion winds up the flexible member to raise the sheet stacking portion.

9. A sheet feeding apparatus according to claim 8, wherein the fixing portion comprises:

an elastic member which is interposed between the sheet stacking portion and the flexible member, the elastic member being in a first state when the sheet stacking portion is located at the lowermost position and elastically deforming from the first state to a second state when the flexible member is wound up by the raising and lowering portion; and a portion to be engaged which engages with the elastic member when the elastic member is in the first state.

10. A sheet feeding apparatus according to claim 8, wherein the fixing portion comprises:

an engaging portion which is pivotably provided on the sheet stacking portion, the engaging portion being coupled to the flexible member so as to be located at a first position when the sheet stacking portion is located at the lowermost position and pivot from the first position to a second position when the flexible member is wound up by the raising and lowering portion; and a fitting hole which is provided in the sheet storing portion and into which the engaging portion is fitted when the engaging portion is located at the first position.

11. An image forming apparatus, comprising:

an image forming portion configured to form an image on a sheet; and feeding apparatus according to claim 8, the sheet feeding apparatus being configured to feed the sheet to the image forming portion.

* * * * *